US005656885A

United States Patent [19]

Kohno et al.

[11] Patent Number: 5,656,885

[45] Date of Patent: Aug. 12, 1997

[54] FLAT CRT HAVING A CARBON LAYER ON AN INNER SURFACE OF A BACK PANEL

[75] Inventors: Yoji Kohno; Ichiro Utsumi, both of Kanagawa, Japan

[73] Assignee: Sony Corporation, Tokyo, Japan

[21] Appl. No.: 11,354

[22] Filed: Jan. 29, 1993

[30] Foreign Application Priority Data

Feb. 17, 1992 [JP] Japan ..... 4-029739

[51] Int. Cl.[6] ..... H01J 31/00

[52] U.S. Cl. ..... 313/479; 313/422; 313/485; 315/14

[58] Field of Search ..... 313/422, 479, 313/479 R, 485; 315/14; 65/56

[56] References Cited

U.S. PATENT DOCUMENTS

| | | | |
|---|---|---|---|
| 2,795,729 | 6/1957 | Gabor | 315/14 |
| 3,299,314 | 1/1967 | Yamada et al. | 313/422 |
| 3,890,541 | 6/1975 | McCarthy et al. | 315/366 |
| 4,325,489 | 4/1982 | Russell et al. | 220/2.2 |
| 4,339,482 | 7/1982 | Glaser et al. | 428/13 |
| 4,339,694 | 7/1982 | Ohkoshi et al. | 315/366 |
| 4,564,785 | 1/1986 | Sato et al. | 313/422 |
| 4,588,430 | 5/1986 | Sumiyoshi et al. | 65/56 |
| 4,723,090 | 2/1988 | Maeda et al. | 313/422 |
| 4,743,797 | 5/1988 | Emberson et al. | 313/422 |
| 4,827,185 | 5/1989 | Theil et al. | 313/479 |
| 5,025,490 | 6/1991 | Tamura | 313/479 |

*Primary Examiner*—Alvin E. Oberley
*Assistant Examiner*—Lawrence O. Richardson
*Attorney, Agent, or Firm*—Jay H. Maioli

[57] ABSTRACT

The present invention is directed to a transmission type flat cathode ray tube in which a flat glass tube envelope (15) is formed of a triple structure having a screen panel (11), a back panel (12) and a funnel portion (14) having a neck portion (13). A carbon film (24) to which an anode voltage is applied is formed on the inner surface of the back panel 12 in an opposing relation to a phosphor screen (19) of the screen panel (11). Thus, the occurrence of a pseudo signal in the transmission type flat cathode ray tube can be avoided.

1 Claim, 6 Drawing Sheets

FLAT CRT HAVING A CARBON LAYER ON AN INNER SURFACE OF A BACK PANEL

BACKGROUND OF THE INVENTION

1. Field of the Invention

The present invention relates to a transmission type flat CRT (cathode ray tube) and, more particularly, to a flat CRT having a carbon layer on an inner surface of a back panel.

2. Description of the Prior Art

A conventional reflection type flat CRT (cathode ray tube) 6 includes a flat glass tube envelope 5 that is formed by a triple structure of a screen panel 1, a front panel 2 and a funnel portion 4 having a neck portion 3 as shown in FIG. 1. More specifically, the flat glass tube envelope 5 consists of the screen panel 1 and the front panel 2 that are bonded in an opposing relation by frit glass so as to form a flat space 7 therebetween, the funnel portion 4 being bonded and sealed to one side of the screen panel 1 and the front panel 2 similarly by frit glass and the neck portion 3 being welded to the funnel portion 4 at its end towards the small-diameter opening. An electron gun 8 is disposed within the neck portion 3.

A phosphor screen 9 is deposited on the inner surface of the screen panel 1 via a reflecting layer (not shown) formed of aluminum vapor deposition film or the like. An electron beam e emitted from the electron gun 8 impinges upon and scans the phosphor screen 9 in the horizontal and vertical directions. Then, an optical image excited and made luminous by the electron beam e is observed from the front panel 2 side opposing the screen panel 1.

There is developed a transmission type flat CRT 16 using a flat glass tube envelope 15 that is formed of a triple structure composed of a screen panel 11, a back panel 12 and a funnel portion 14 having a neck portion 13 as shown in FIG. 2. A phosphor screen 19 is formed on the inner surface of the screen panel 11 through a transparent conductive film, e.g., ITO (indium oxide-tin oxide) film (not shown). Then, an electron beam e emitted from an electron gun 18 impinges upon and scans the phosphor screen 19 in the horizontal and vertical directions and an optical image excited and made luminous by the electron beam e is observed from the screen panel 11 side.

In such transmission type flat CRT 16, when a part of the electron beam e strikes the back panel 12 to place negative electric charges 20 on the inner surface of the back panel 12, there is then the risk that a passage of the electron beam e is displaced by the negative electric charges 20. In particular, the influence of negative electric charges 20 on the electron beam e becomes pronounced in the top of the CRT 16 so that a pseudo signal occurs. The pseudo signal is an aliasing noise or smear noise which occurs in an image when the electron beam e scans the phosphor screen 19 on a scanning line inside the original scanning line due to the negative electric charges 20 thus charged as shown by a dashed line in FIG. 2.

OBJECTS AND SUMMARY OF THE INVENTION

In view of the aforesaid shortcomings and disadvantages of the prior art, it is an object of the present invention to provide a transmission type flat cathode ray tube in which a pseudo signal can be prevented from being generated.

Another object of the present invention is to provide a transmission type flat cathode ray tube which can be extended in lifetime.

Still another object of the present invention is to provide a transmission type flat cathode ray tube which can be improved in contrast.

A further object of the present invention is to provide a transmission type flat cathode ray tube which can be made inexpensive.

According to an aspect of the present invention, there is provided a transmission type flat cathode ray tube which comprises a flat tube envelope formed of a triple glass structure, a phosphor screen being formed on an inner surface of a screen panel, and a conductive film to which a high voltage is applied being formed on an inner surface of a back panel opposing the screen panel.

The above and other objects, features, and advantages of the present invention will become apparent from the following detailed description of an illustrative embodiment thereof to be read in conjunction with the accompanying drawings, in which like reference numerals are used to identify the same or similar parts in the several views.

DETAILED DESCRIPTION OF THE PREFERRED EMBODIMENT

The present invention will now be described with reference to the drawings.

Figure 1:
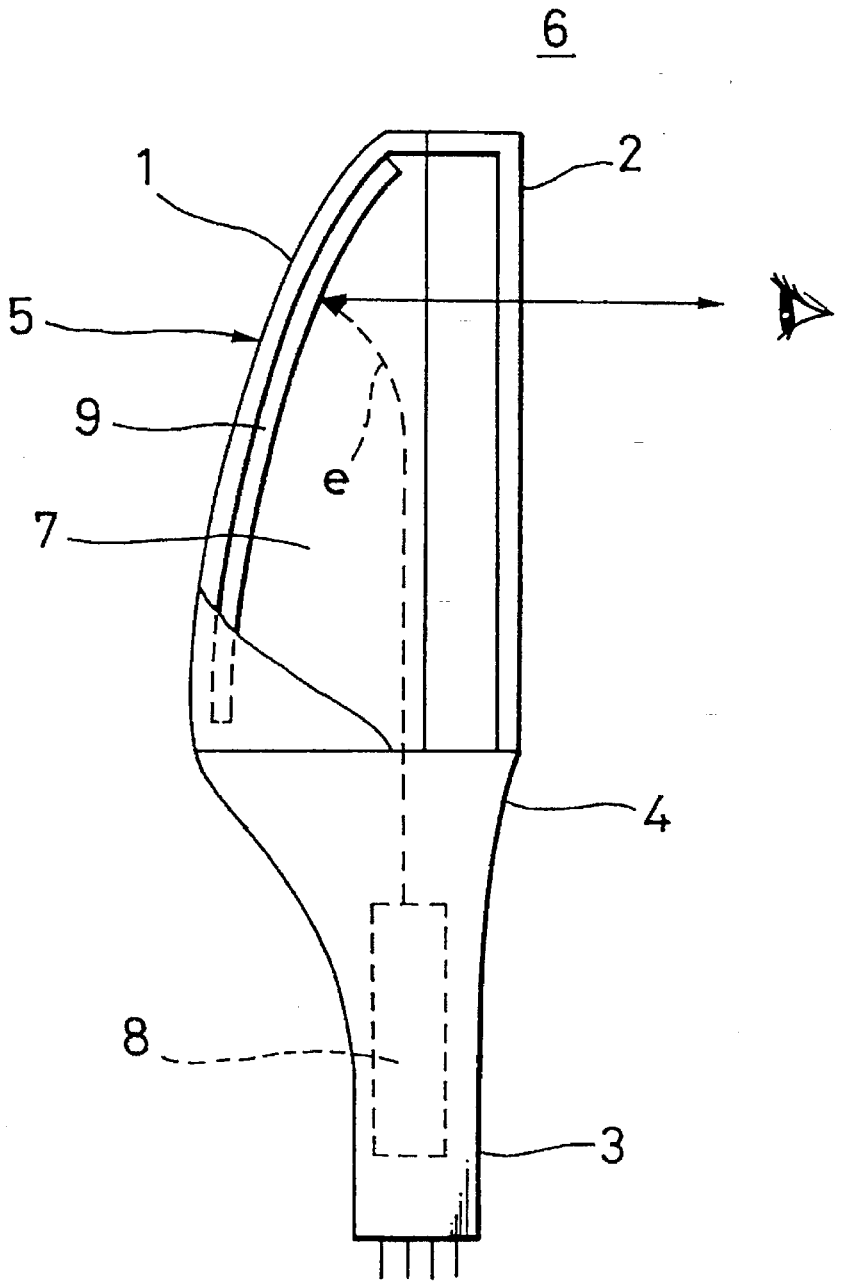
FIG. 1 (PRIOR ART)
FIG. 1 is a cross-sectional view of a conventional reflection type flat cathode ray tube.
Figure 2:
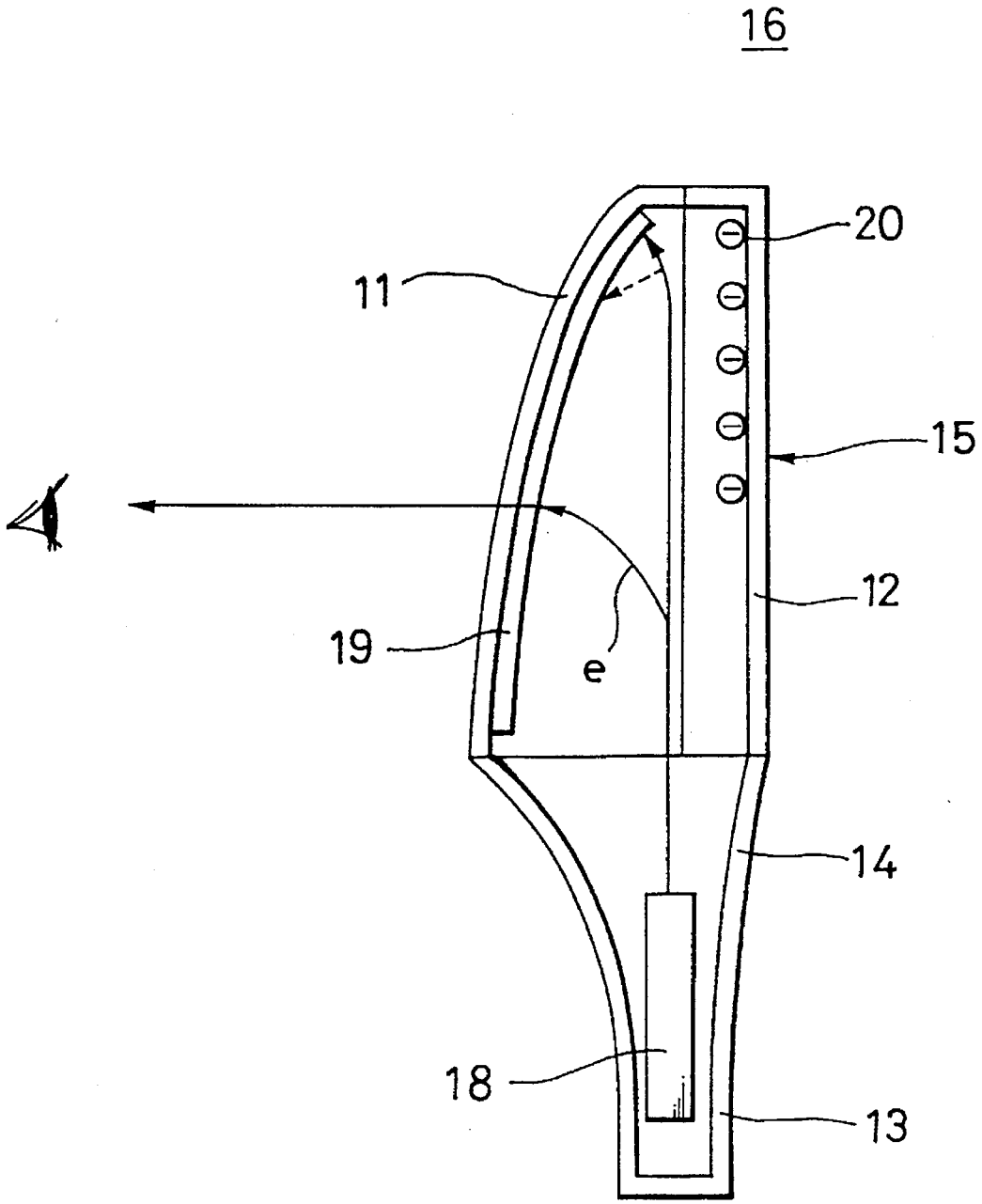
FIG. 2 (PRIOR ART)
FIG. 2 is a cross-sectional view showing a comparative example of a conventional transmission type flat cathode ray tube.
Figure 3:
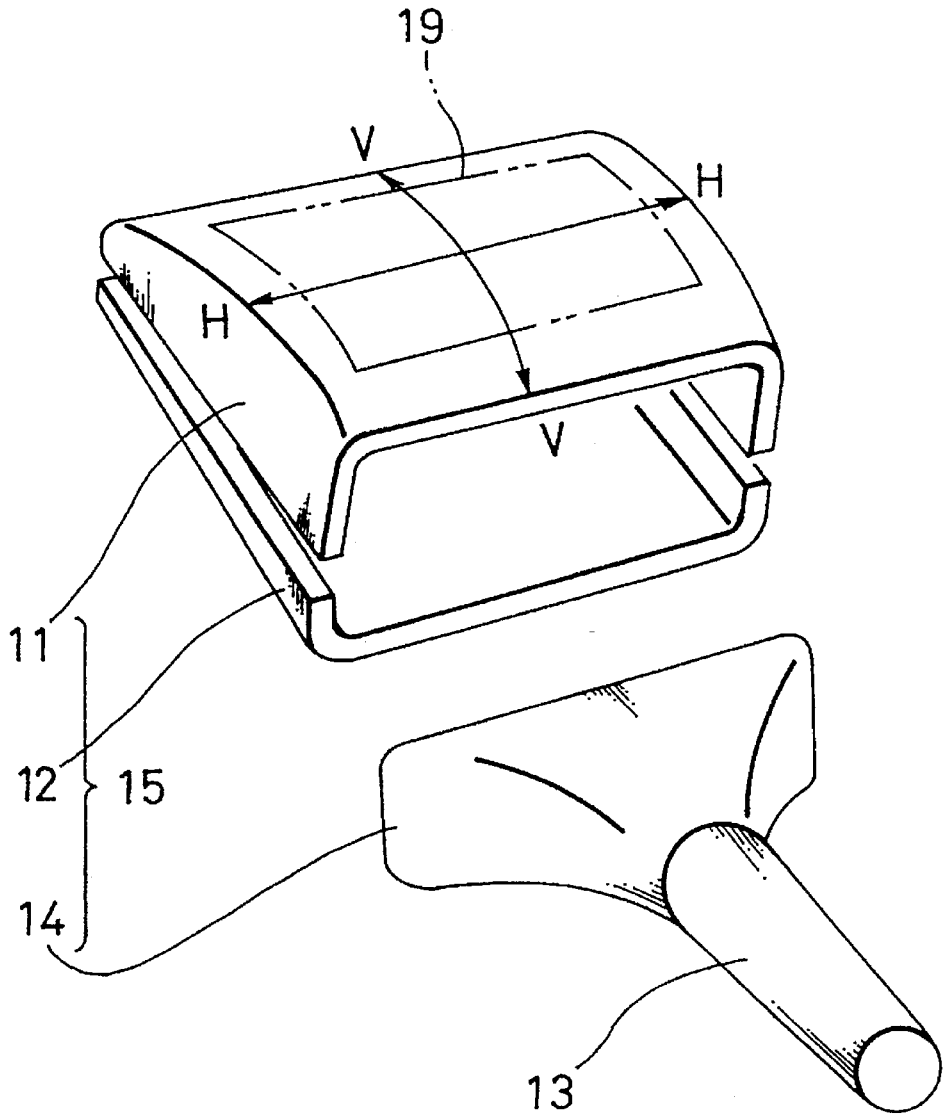
FIG. 3 is an exploded perspective view showing an embodiment of a flat glass tube envelope made by a triple structure according to the present invention.

According to an embodiment of the present invention, as shown in FIG. 3, a flat glass tube envelope 15 is made of a glass triple structure including a screen panel 11, a back panel 12 and a funnel portion 14 having a neck portion 13. The flat glass tube envelope 15 is constructed by fritting three of the screen panel 11, the back panel 12 and the neck portion 13. The screen panel 11 has a curved surface which is flat in the horizontal direction H—H and which has a predetermined curvature in the vertical direction V—V perpendicular to the horizontal direction H—H as shown in FIG. 3.

Figure 4:
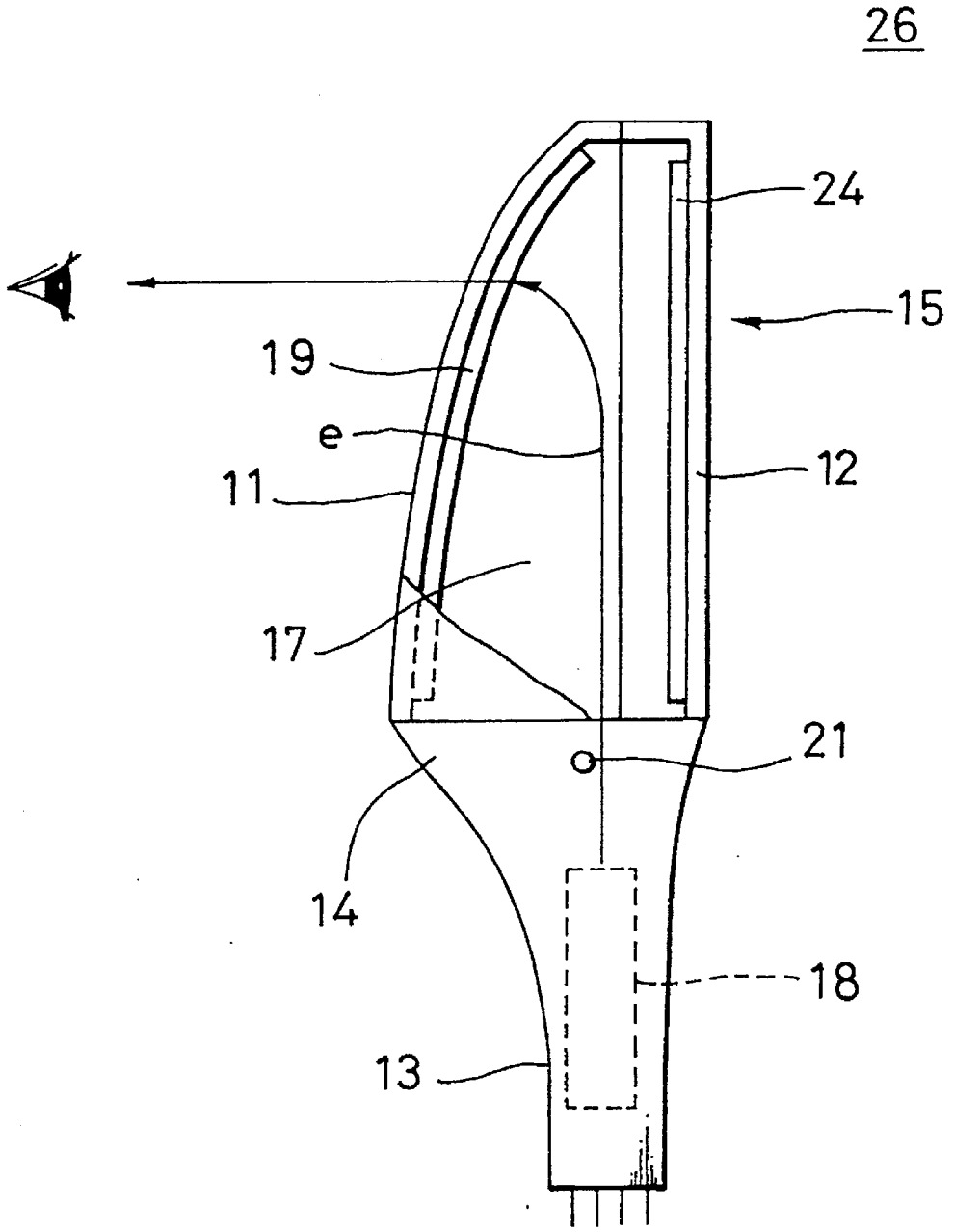
FIG. 4 is a cross-sectional view showing the embodiment of a transmission type flat cathode ray tube according to the present invention.
Figure 5:
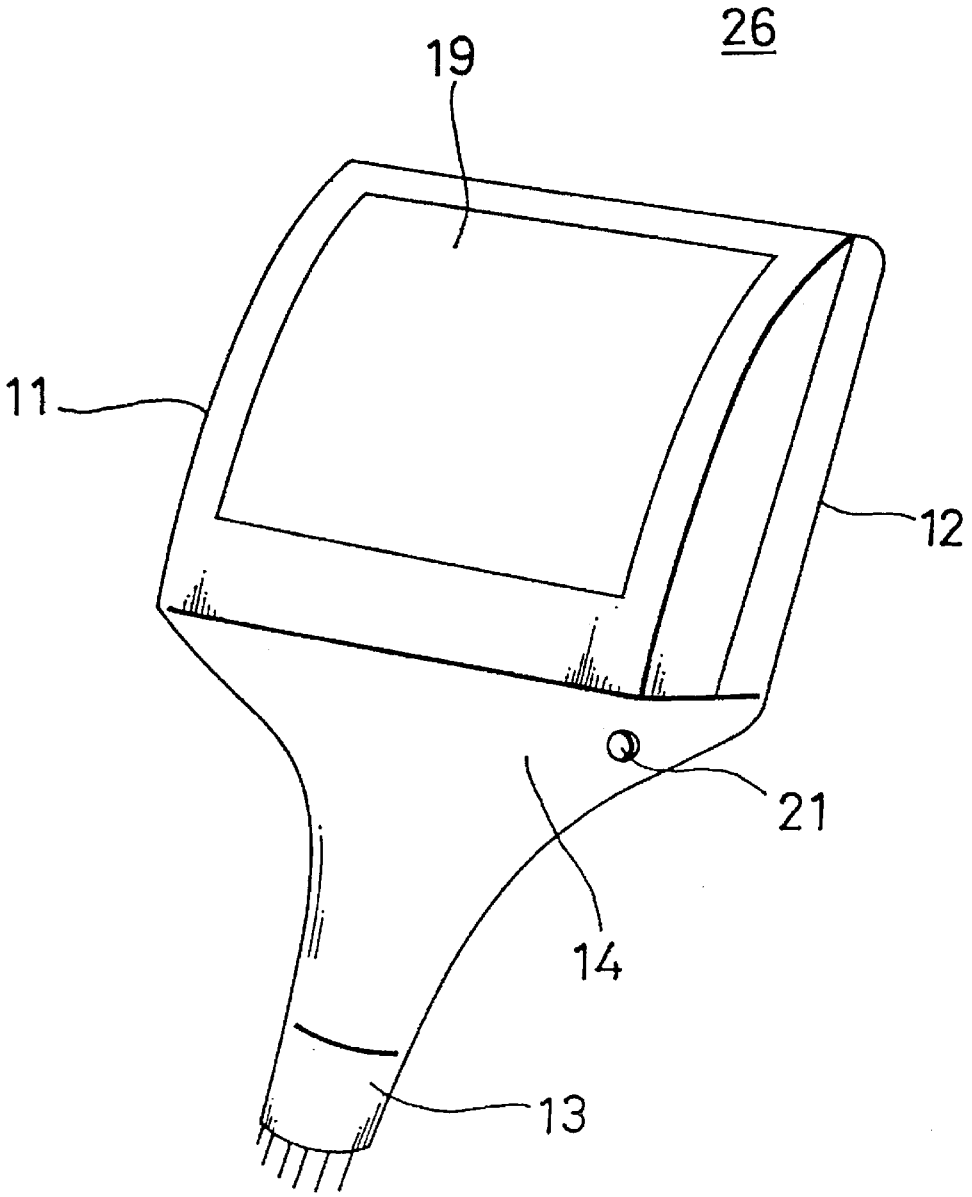
FIG. 5 is a perspective view showing the embodiment of the transmission type cathode ray tube according to the present invention.

As shown in FIGS. 4 and 5, a phosphor layer, i.e., phosphor screen 19 is formed on the inner surface of the screen panel 11 through a transparent conductive film, e.g., ITO film (not shown), and an electron gun 18 is disposed within the neck portion 13. The funnel portion 14 has a high voltage anode button 21 embedded therein for applying an anode voltage HV. On the inner surface of the funnel portion 14, there is deposited an inner carbon layer 23 (see FIG. 6) that is connected to the anode button 21. The ITO film and the inner carbon layer 23 of the funnel portion 14 are connected through a connection carbon layer (not shown) to apply the anode voltage to the phosphor screen 19.

Figure 6:
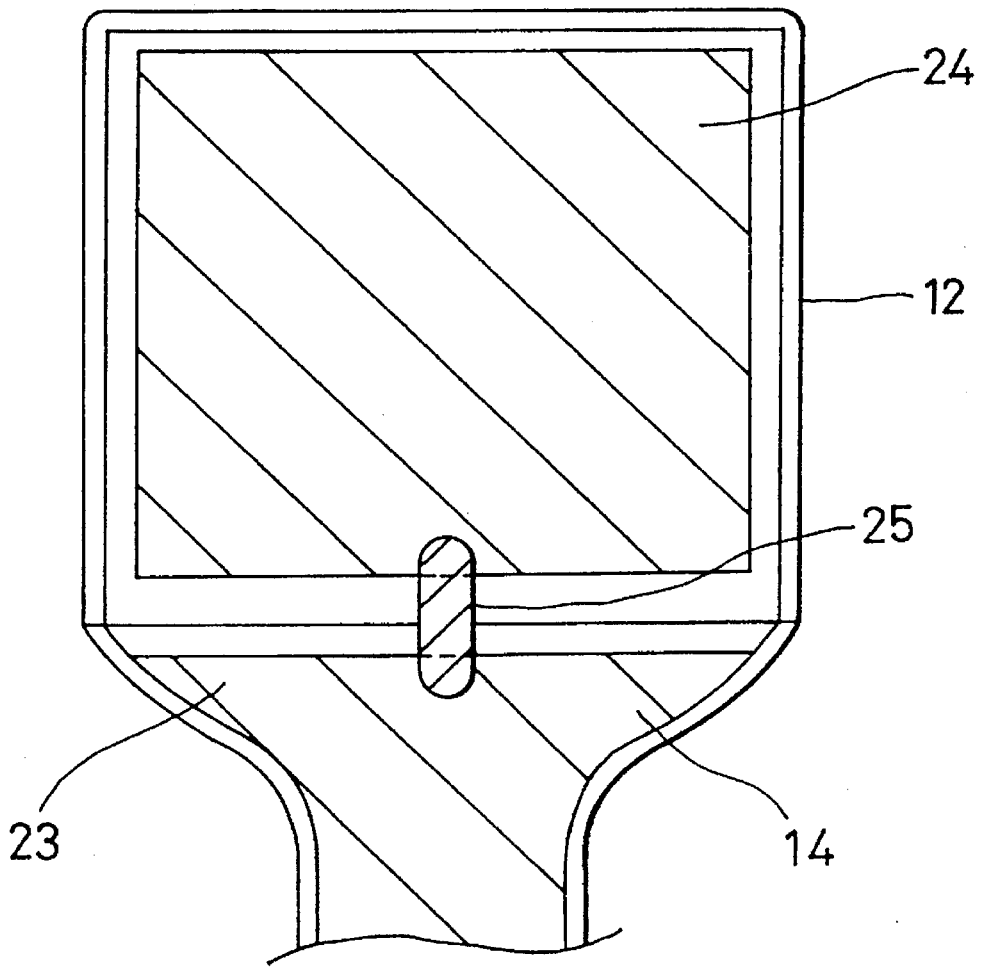
FIG. 6 is a plan view of a main portion of the transmission type flat cathode ray tube according to the present invention.

According to this embodiment, as shown in FIGS. 4 and 6, a conductive layer, e.g., carbon film 24 is deposited on substantially the whole surface of the inner surface of the back panel 12 in an opposing relation to the fluorescent surface 19. The carbon film 24 and the inner carbon film 23 deposited on the inner surface of the funnel portion 14 are connected by means of a connecting carbon film 25, for example, to apply the anode voltage HV to the carbon film 24.

In a transmission type flat cathode ray tube 26 thus constructed, an electron beam from the electron gun 18 impinges upon and scans the phosphor screen 19 formed on the inner surface of the screen panel 11 in the horizontal and vertical directions so that an optical image excited and made luminous by the electron beam is observed from the screen panel 11 side.

According to the above-mentioned arrangement, since the carbon film 12 to which the anode voltage is applied is formed on the inner surface of the back panel 12 in an opposing relation to the phosphor screen 19, negative electric charges can be prevented from being charged on the inner surface of the back panel 12. Simultaneously, the inside of a flat space 17 formed between the screen panel 11 and the back panel 12 is set in a so-called no-electric field state because the same anode voltage is applied to the phosphor screen 19 and the carbon film 24. Therefore, since the electron beam e emitted from the electron gun 18 impinges upon and scans the phosphor screen 19 only by the deflection of an electromagnetic deflection means (not shown) in the horizontal and vertical directions, the trace of the electron beam e can be prevented from being displaced, thereby avoiding the occurrence of the aforementioned pseudo signal.

Since the carbon layer 24 is formed on the inner surface of the back panel 12, the area of the carbon film within the flat glass tube envelope 15 is increased. Also, since the carbon film 24 itself has a gas adsorbing effect, a so-called gettering effect can be increased on the whole and the degree of vacuum within the flat glass tube envelope 15 can be improved more, which can extend the lifetime of the cathode. Accordingly, the lifetime of the transmission type flat cathode ray tube is extended.

Further, since the carbon film 24 is formed on the inner surface of the back panel 12, the rear portion of the phosphor screen 19 is treated by a blackening process. Therefore, when a picture is displayed, black color is blackened as compared with the phosphor screen that is not treated by the blackening process and is made of only glass. Thus, the contrast of a displayed picture can be improved.

Furthermore, the carbon film 24 is not formed by a so-called vapor deposition method so that the transmission type flat cathode ray tube of the present invention can be manufactured inexpensively.

While the carbon layer 24 is employed as the conductive film formed on the inner surface of the back panel 12 as described above, the present invention is not limited thereto and other conductive films such as a transparent conductive film (e.g., ITO film) or the like may be used.

In addition, while the conductive film, i.e., carbon film 24 is deposited on the whole surface of the inner surface of the back panel 12 as described above, the present invention is not limited thereto and the conductive film may be formed only near the upper end of the back panel 12 in which the pseudo signal tends to occur.

In the transmission type flat cathode ray tube of the present invention, since the conductive film to which the high voltage is applied is formed on the inner surface of the back panel, the influence of electrostatic capacity occurring in the back panel can be removed and the occurrence of a pseudo signal can be avoided.

Having described a preferred embodiment of the invention with reference to the accompanying drawings, it is to be understood that the present invention is not limited to that precise embodiment and that various changes and modifications could be effected therein by one skilled in the art without departing from the spirit or scope of the invention as defined in the appended claims.

What is claimed is:

1. A transmission type flat cathode ray tube comprising:

a flat tube envelope formed of a triple glass structure including a transparent front screen panel through which a displayed image formed on an inner surface of said front screen panel is visible from the front, a back panel having a rectangular flat portion opposing said screen panel, and a funnel portion having embedded therein an anode button for receiving a high voltage;

a phosphor screen formed on an inner surface of said front screen panel and having a transparent conductive film formed thereover, whereby an image formed on said phosphor screen is viewed by a viewer through said front screen panel;

a first conductive carbon film formed on an inner surface of said funnel portion and in electrical contact with said transparent conductive film formed over said phosphor screen and in electrical contact with said anode button embedded in said funnel portion, whereby said high voltage fed to said anode button is applied to said first conductive carbon film and to said transparent conductive layer;

means for preventing an accumulation of negative electric charge on an inner surface of said back panel of said transmission type flat cathode ray tube, said means including a second conductive carbon film having a rectangular shape and a size substantially corresponding to said phosphor screen formed on an inner surface of the rectangular flat portion of said back panel in opposing relation to said phosphor screen, said second conductive carbon film being separated from said phosphor screen by a flat space formed between said front screen panel and said back panel, said second conductive carbon film being black in color, and said means further including a third conductive carbon film arrayed at a jointure between said back panel and said funnel portion for electrically connecting said first and second conductive carbon films, whereby said high voltage fed to said anode button is applied to said second conductive carbon film formed on said inner surface of the rectangular flat portion of said back panel, and said transparent conductive film formed over said phosphor screen and said second conductive carbon film have the same voltage applied thereto.

* * * * *